US006425646B1

(12) United States Patent
Andrews

(10) Patent No.: US 6,425,646 B1
(45) Date of Patent: Jul. 30, 2002

(54) COMBINATION DISPLAY STAND AND ARTIFICIAL CHRISTMAS TREE

(76) Inventor: Gloria J. Andrews, 3313 Kenilworth La., Knoxville, TN (US) 37917

( * ) Notice: Subject to any disclaimer, the term of this patent is extended or adjusted under 35 U.S.C. 154(b) by 38 days.

(21) Appl. No.: 09/660,878

(22) Filed: Sep. 13, 2000

(51) Int. Cl.[7] ..... A47F 3/00

(52) U.S. Cl. ..... 312/114; 312/204; 108/92; 362/252

(58) Field of Search ..... 108/23, 92, 50.02; 312/223.5, 223.6, 114, 281, 282, 204; 211/134, 186; 362/123, 249, 252

(56) References Cited

U.S. PATENT DOCUMENTS

| | | | | | |
|---|---|---|---|---|---|
| 870,259 | A | * | 11/1907 | Tenney | 108/92 |
| 1,577,207 | A | * | 3/1926 | Dieperink-langereis | 362/123 X |
| 1,954,601 | A | * | 4/1934 | Sowerwine | 108/92 |
| 2,414,866 | A | * | 1/1947 | Glaser | 362/123 X |
| 3,170,418 | A | | 2/1965 | Gruenstein | |
| 3,674,612 | A | | 7/1972 | Gehl, Jr. | |
| 3,819,459 | A | * | 6/1974 | Wren | 362/123 |
| 5,001,614 | A | * | 3/1991 | Buss | 362/249 X |
| 5,072,343 | A | * | 12/1991 | Buers | 362/249 X |
| D330,129 | S | | 10/1992 | Kelly | |
| 5,297,012 | A | * | 3/1994 | Fletcher | 362/252 |
| 5,359,502 | A | * | 10/1994 | Cantin | 362/123 |
| 5,404,279 | A | * | 4/1995 | Wood | 362/249 X |
| 5,639,521 | A | | 6/1997 | Fraus et al. | |
| 5,712,770 | A | * | 1/1998 | Huang | 362/252 |
| 5,735,415 | A | | 4/1998 | Wilson | |
| 5,752,611 | A | | 5/1998 | Nakagawa | |
| 5,758,948 | A | * | 6/1998 | Hale | 362/123 |

FOREIGN PATENT DOCUMENTS

| | | | | |
|---|---|---|---|---|
| DE | 3914678 | * | 11/1990 | 362/123 |
| FR | 2636827 | * | 3/1990 | 362/123 |

* cited by examiner

*Primary Examiner*—Lanna Mai
*Assistant Examiner*—Hanh V. Tran
(74) *Attorney, Agent, or Firm*—Robert M. PoteatPC

(57) ABSTRACT

A display stand for displaying plants, ornamental items, merchandise or the like which can be quickly converted to provide a lighted artificial Christmas tree. The display stand includes an open upright triangular shaped assembly resembling the outline of a Christmas tree when viewed from the front or back of the display stand. The display stand structure includes a plurality of horizontally disposed display shelves within and supported by the triangular shaped assembly to provided surfaces upon which articles may be displayed thereon. The assembly includes a plurality of decorative electrical Christmas lights permanently disposed about the perimeter edges within front and rear facing channels with removable covers disposed thereover. The covers may be removed to reveal the decorative lights so that the display stand is converted to resembling a lighted Christmas tree. A cabinet may be mounted at the base of the tree structure to accommodate storage of various items, like seasonal related material such as wrapping paper, bows, cards and the like.

17 Claims, 5 Drawing Sheets

COMBINATION DISPLAY STAND AND ARTIFICIAL CHRISTMAS TREE

BACKGROUND OF THE INVENTION

This invention relates generally to display devices for displaying plants, ornamental items, merchandise and the like and more particularly to a display device and system which can be quickly converted to provide a lighted artificial Christmas tree.

During the Christmas holiday season, it has become the practice of many households and businesses to display an artificial Christmas tree as the central decorative item to celebrate the season. In many cases there is limited space for the location of the tree within the living or merchandising space available. In most of these situations various display devices are normally used to display plants, non seasonal ornaments or art pieces, or merchandise which would also have to be moved or removed from the home or business to make room for the placement of a Christmas tree. Further, the use of an artificial tree requires the space to store the tree when not in use during the Christmas season as well as considerable time, energy and aggravation to erect the tree and install the lighting on the tree. Many artificial trees require branches of the tree to be inserted into a trunk assembly, which requires considerable time and frustration during assembly, as well as the installation of a base structure to support the tree in the upright position. This process requires removing the tree form storage along with the lights and ornaments to be placed on the tree and then taking the tree down and returning it to storage a short time later.

Further, in the case of the physically challenged which enjoy celebrating the Christmas season with the display of a lighted Christmas tree within the home or in front of a window in the home, it may be impossible to handle these tasks associated with the erection and decoration of a Christmas tree. Thus, it will be seen that there is a need to provide an attractive display stand that can be normally used to display plants, ornamental items and the like which could also provide the central Christmas decoration during the Christmas holidays. The convertible display stand will save the time, energy and aggravation associated with erecting and decorating a conventional Christmas tree and the associated removal and storage of the tree.

SUMMARY OF THE INVENTION

In view of the above need, it is an object of the present invention to provide a display stand which can be quickly converted to expose lighting about the structural perimeter of the stand to resemble a lighted Christmas tree.

Further it is a object of this invention to provide a display stand which can not only be converted to an artificial Christmas tree but to provide a furniture assembly which is composed of simple durable components that may be readily manufactured and assembled to provide an attractive piece of furniture.

Another object of this invention is to provide a convertible display stand as in the above objects which may be used as a piece of furniture for either a home, office or commercial applications year round while providing an artificial Christmas tree as the central decorative item to celebrate the Christmas season.

In accordance with the present invention, the combination display stand and artificial Christmas tree includes a display stand structure in the form of an open upright triangular shaped assembly resembling the outline of a Christmas tree when viewed from the front or back of the display stand. The display stand structure includes a plurality of horizontally disposed display shelves within and supported by the triangular shaped assembly to provided surfaces upon which articles may be displayed thereon. The assembly includes a plurality of decorative electrical Christmas lights disposed about the perimeter edges of the assembly and a removable cover disposed over the decorative lights which normally covers the lights from view while allowing the lights to be viewed upon removal of the cover, resembling a Christmas tree.

The plurality of shelves disposed within the structure each include a front edge and back edge forming a portion of the perimeter edges of the display assembly into which the plurality of lights are likewise disposed so that the lights along the edges of the shelves are also visible when the covering is removed to reveal the lights. The shelves may include a removable floor that is preferably formed of a transparent material to allow light to pass therethrough, especially when the stand is used as a plant display stand.

The triangular assembly may take the form of a pair of triangular shaped assemblies forming front and rear spaced apart triangular shaped assemblies each formed of tubular structural elements into which the electrical lights, and associated wiring, may be disposed and covered out of view when the display stand is being used primarily as a display stand or the like. The tubular members may include a hinged cover portion along the length thereof forming a part of the tubular enclosure which allows the cover to be rotated out of the light covering position to allow the lights to be exposed for viewing. The assemblies may be spaced apart from front to back by means of integral support members which also form end members for the plurality of shelves of the assembly. The assembly of the pair of triangular shaped assemblies may include a cap member connected between the apexes of the front and rear triangular assemblies to form a decorative structural member. The cap may also include a removable stem at the top thereof to provide a mount for an ornament or the like, such as a lighted star or angel or the like tree topper ornament. An electrical receptacle may be provided in the hood to provide a convenient electrical outlet for a lighted tree topper ornament.

In accordance with one embodiment of the present invention, there is included a storage compartment disposed in the area between the base of the upright triangular assembly and a first one of the shelves disposed above the base of the assembly. The storage compartment may include at least one storage drawer disposed therein for storage of seasonal related items or the like, such as Christmas rapping paper, bows, cards and the like or other items which are normally stored out of view. Wheels may be provided on the base of the assembly to allow the display stand to be easily moved from one location to another. This embodiment may be used in front of a full length window area, such as a patio door or window such that the lights, when uncovered, would be in full view through the window.

In accordance with another embodiment of the present invention, there is included a base cabinet on which the base of the upright triangular assembly of the display stand is disposed. The base cabinet may include at least one drawer for storing seasonal related items or the like as in the above embodiment. Typically the base cabinet is a wood or wood veneer structure consistent with the look of a furniture article and may include wheels on the base to provide mobility for the display stand. The cabinet may include other drawers or shelves for storing items therein. This embodiment of the convertible display stand may be useful for display in front of a partial length window so that the display stand triangular assembly would be visible through the shorter window and the decorative Christmas lights forming the tree outline would be in full view through the window when uncovered and turned on.

In either embodiment, the base cabinet or enclosure may include the electrical controls for controlling the ornamental Christmas lights and any display lights used to illuminate the shelves of the display.

The display stand may further include a number of electrical receptacles located in the tubular frame work at the various shelf levels to provide convenient electrical outlets into which lamps, various lighted ornamental items or the like may be plugged into.

Further, especially when the display stand is used as a plant display stand, each shelf may be illuminated by appropriate electrical lighting disposed in the display stand structure above each of the plurality of shelves. The lights may take the form of miniature fluorescent tube type electrical lights which may be easily disposed behind the structural members of the assembly so that they are out of plain view.

Other objects and many of the attendant advantages of the present invention will be apparent from the following detailed description and claims taken in conjunction with the drawings.

DETAILED DESCRIPTION OF THE PREFERRED EMBODIMENTS

Figure 1:
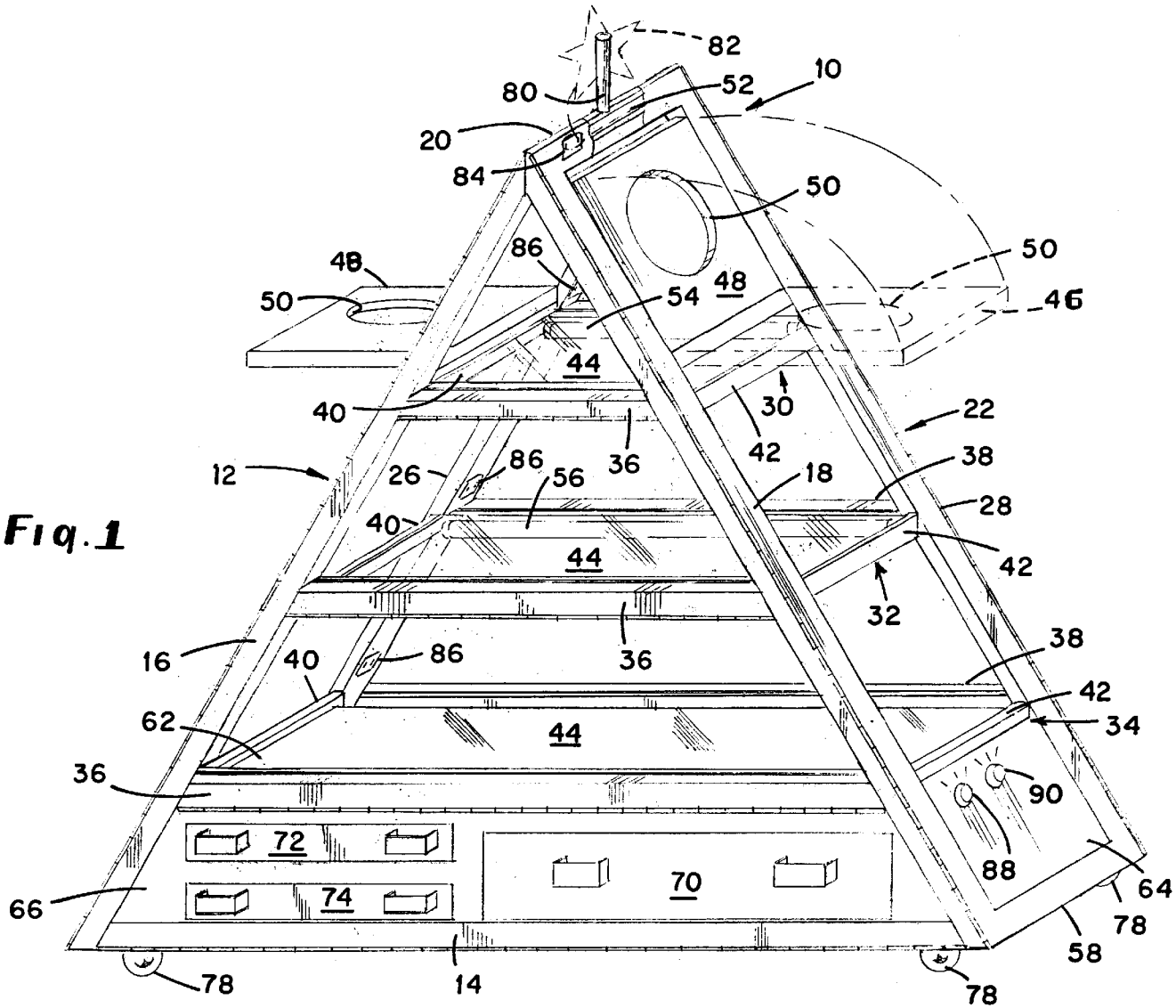
FIG. 1 is a perspective view of one embodiment of the combination display stand and lighted Christmas tree of the present invention including a lower storage compartment located in the base region of the triangular shaped display stand.

Referring now to FIG. 1, the overall general structure of a combination display stand and artificial Christmas tree according to the present invention is generally indicated at 10. The stand can be converted to provide an artificially lighted display resembling a lighted Christmas tree upon exposure of appropriate decorative lighting disposed all about the perimeter in the tubular structural members of the display stand as will be described hereinbelow. As shown in FIG. 1, the display stand includes at least one triangular shaped structural member 12 including a base 14 and upwardly extending side members 16 and 18 which are attached to the base at opposite ends thereof and extend from opposite ends of the base member 14 to a common connecting point at the apex which includes a cap 20 at the top of the triangular structure. The triangular structure 12 is appropriately proportioned by selecting the width of the base and the length of the side members 16 and 18 to resemble the profile of a Christmas tree when viewed from the front or back of the structure.

Figure 2:
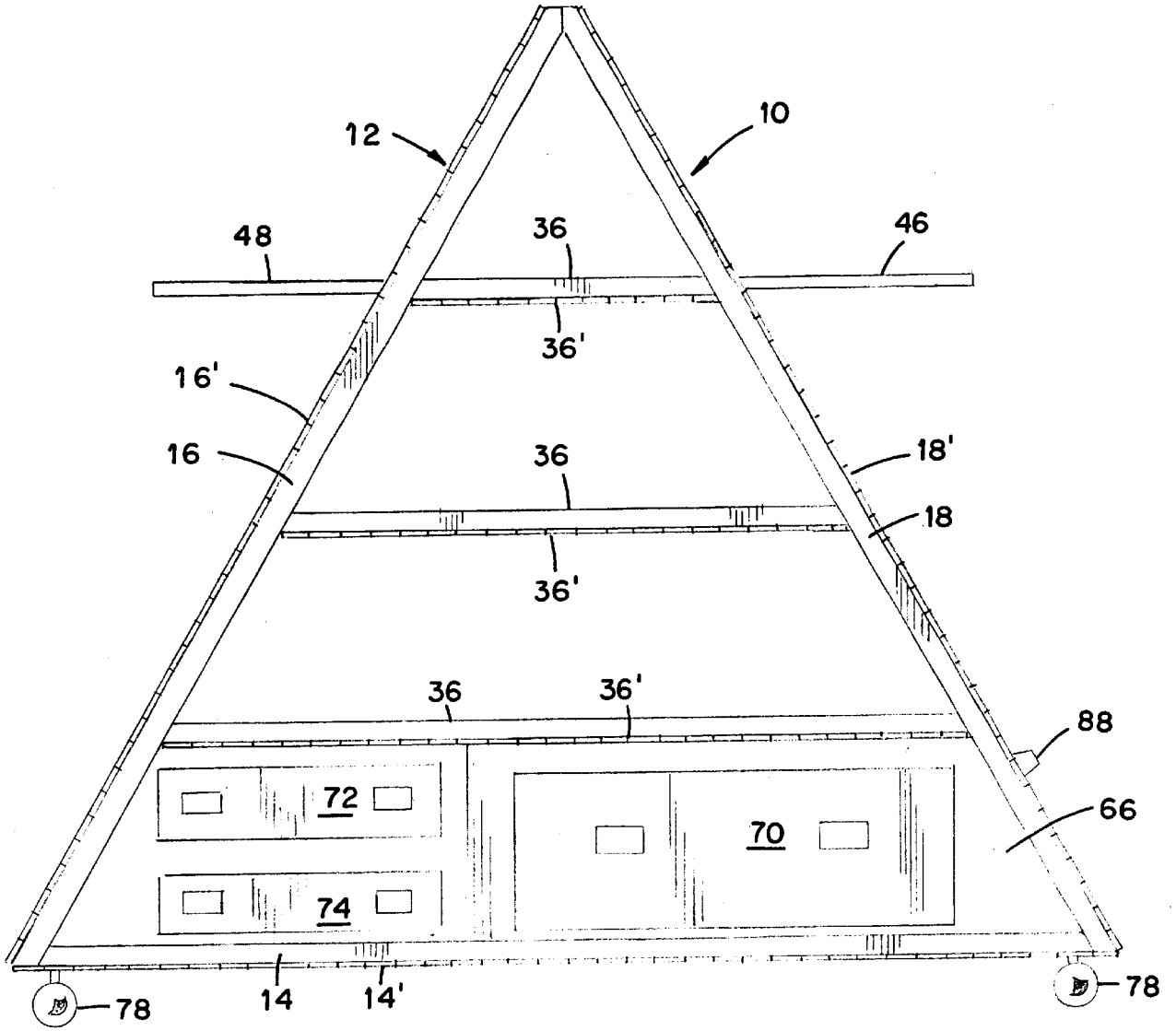
FIG. 2 is a front elevational view of the display stand shown in FIG. 1, wherein like reference numerals indicate like parts to that shown in FIG. 1.
Figures 3, 4:
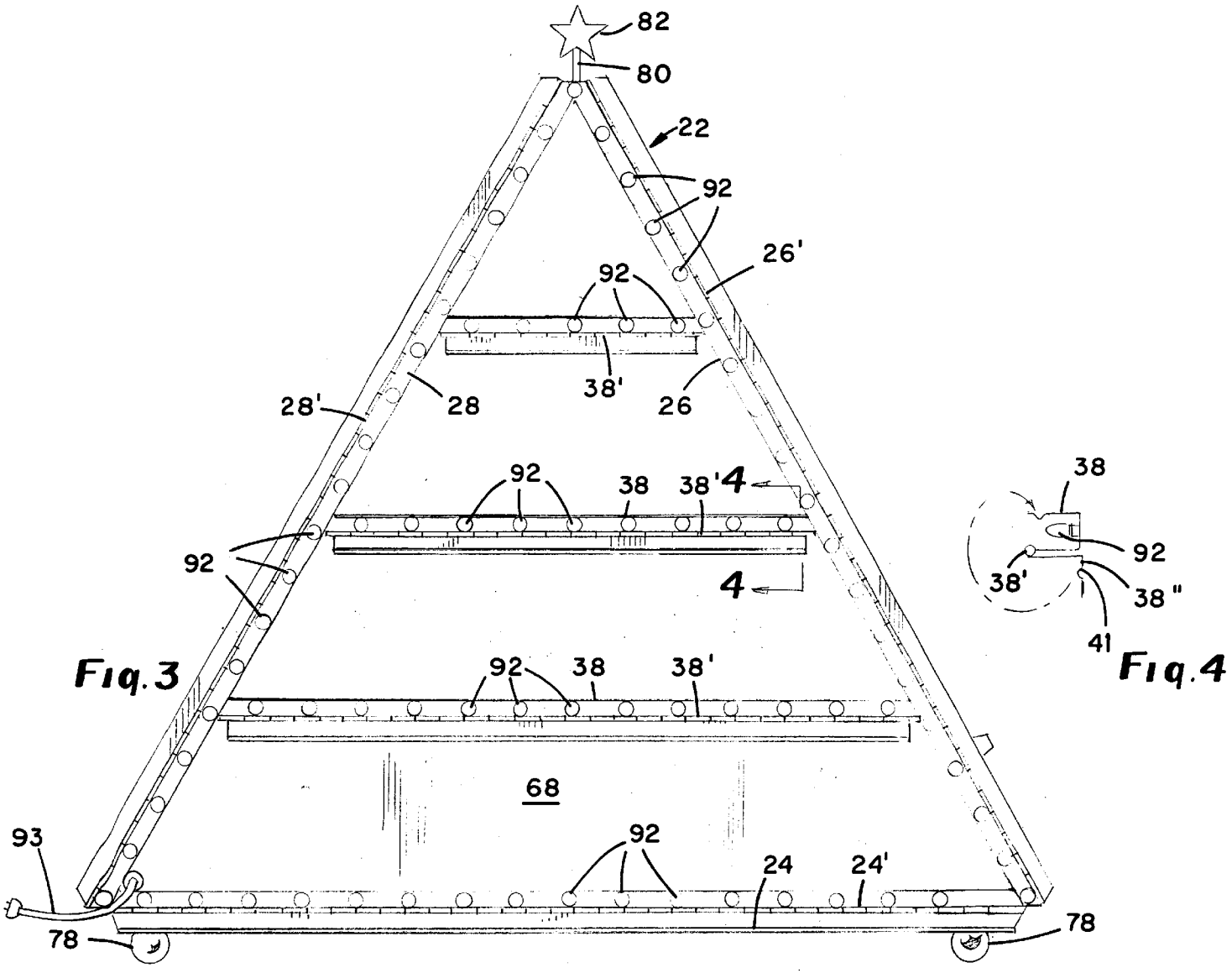
FIG. 3 is a rear elevational view of the display stand shown in FIG. 1, illustrating the display of decorative lights about the outer peripheral edges of the structure when the covers for the lights are removed, wherein like reference numerals indicate identical parts to that shown in FIG. 1.
FIG. 4 is a cross-sectional view of one of the rectangular, tubular structural members of the display stand taken along lines 4—4 of FIG. 3 to illustrate the removable closure member over the decorative lights disposed therein.

Although the display stand could be formed using only on triangular member 12, in the preferred structure, the stand includes a second, or back, triangular structural member 22 spaced from the front member 12 sufficient distance according to the desired depth of the shelving to be supported between the front and back triangular members. Typically, these members are identical in structure and dimensions, as shown in FIGS. 2 and 3, which illustrate the front and back members, respectively. The back member 22 includes a base 24 (not shown in FIG. 1, see FIG. 3) and side members 26 and 28, which likewise extend to the cap 20 of the structure, as shown. Although the triangular members 12 and 22 may be formed of different structural materials, such as wood, metal or plastic, preferably the members are formed of a rectangular cross-section decorative metal tubular material such as a polished silver or gold colored metal with a protective lacquer coating to protect the finish. Typically the cap 20 is in the form of an inverted "V" shaped structural member in which the "V" angle matches that of the triangular structure apex angle. The cap 20 is connected in a conventional manner, as by welding, between the apexes of the front and back triangular structural members 11 and 22.

The display stand includes at least one horizontal shelf; and, in the preferred form of the embodiment shown in FIG. 1, the display stand includes first, second and third shelves 30, 32 and 34. Typically, each of the shelves are identical in structure and vary in size so that they fit within the triangular structure, as shown. Each shelf includes front and back horizontal support members 36 and 38 which form integral parts of the front and back triangular structural members 12 and 22 and part of the perimeter edges of the structure. These support members are constructed of identical tubular materials to that of the triangular members 12 and 22 and include decorative lighting disposed therein with corresponding covers to keep the lights out of view until the covers are removed to reveal the decorative lights, as will be explained hereinbelow. In FIG. 1, all of the tubular members containing the decorative lights are shown in the covered condition. FIG. 3 illustrates the view of the lights in the uncovered condition.

Each shelf may further include a pair of end supports 40 and 42 with upward extending ledges to hold a removable shelf floor insert 44 in place and prevent side to side movement, while allowing the inserts to be removed if desired. Typically, especially when the display unit is designed for displaying plants, the shelves may be formed of a transparent material, such as glass, clear plastic or the like, to allow light to pass therethrough to the plants displayed on the shelves and to protect the cabinet below. The end supports 40 and 42 of each shelf further form a part of the structure of the display stand and are attached between the front and rear members 12 and 22 by means of welding or various other conventional ways of metal to metal attachment These support members may also be made of the same decorative material as the front and rear members 12 and 22.

To provide additional display shelf space, fold out shelves, or shelf extensions, 46 and 48 may be included on either side of the display stand, as shown at the upper shelf 30. These shelves may further include openings 50 therein sized to accommodate various planting pots or the like to add to the versatility of the stand, especially when used as a plant display stand. These shelves are pivotally mounted to the front and rear members 12 and 22, as illustrated, to allow the shelves to be folded up into the structural openings therebetween, as illustrated for shelf 48, and out of view when viewed from the front and b back of the stand.

To further provide illumination for items displayed o n the shelves, each shelf may be lighted by means of appropriate lighting disposed above each shelf. The top shelf m ay b e illuminated by means of an electrical fluorescent tube fixture 52 disposed in, and covered by, the "V" shaped cap 20. The remaining shelves 32 and 34 may be illuminated by similar fluorescent fixtures 54 and 56 disposed along the back sides of either or both of the shelf supports 36 and 38 so that they are out of normal view from either the front or back of the display stand. In the case where the display stand is used to display plants, these fixtures may contain bulbs which are referred to as grow lamps to promote growth of the plants displayed thereon.

The base of the assembly is held together by means of base end structural members 58, only one of which is shown in FIG. 1, that extend between the front and rear triangular members 12 and 22. These structural members may be formed of the same decorative metal as the remainder of metal assembly and attached by means of welding or other conventional means. The members 58 may be in the form of angular cross-sectioned members whose angle matches that of the angle between the bases and sides of the triangular members 12 and 22. In the case wherein re the display structure includes only shelves form top to bottom, the structural members 58 may form ledges upon which a base shelf (not shown) may be placed in the bottom of the display.

However, in the preferred embodiment shown in FIG. 1, the space between the bottom of the display stand and the lower shelf 38 is preferably framed-in to include a storage cabinet 60. The storage cabinet may be made by known furniture manufacturing methods and known manufacturing materials, such as wood, metal or plastic. As shown, the preferred material is a wood or wood veneer material with top 62, end 64 (only one end shown in FIG. 1), front 66 and rear 68(see FIG. 3) panels which fit within the confines of the display stand structure 10 between the base members 14 and 24 and the first shelf 34 above the bases, as shown, to form an attractive furniture finished cabinet. The cabinet may include a number of drawers or storage compartments as illustrated here by means of the drawers 70–74 disposed in the front panel 66 of the cabinet. Typically, the drawers would be provided for storage of seasonal materials, such as cards, scissors, gift tags, bows or wrapping paper and the like. One of the drawers, such as drawer 70 may be sized to accommodate tubes of wrapping material for Christmas gifts and the like used during the Christmas season.

The display stand 10 may further include appropriate wheels or casters 78, preferably attractive furniture type casters, mounted on the four corners of the base of the display structure, so that the display stand may be easily moved about for access thereto or to move the stand to different areas of the room or building in which the stand is placed.

As shown in FIG. 1, the cap 20 is provided with an upright, decorative stem 80 disposed in the cap 20 upon which a treetop ornament, such as an angel or lighted star 82, as illustrated here, may be mounted when the display stand is converted to an artificial Christmas tree and the lights about the perimeter of the stand are uncovered to reveal the outline of a lighted artificial tree. The stem may take the form of a decorative metal stem permanently mounted in the cap 20, or take the form of a removable stem threadably mounted in the cap 20 or hinged thereto to allow removal, as shown in FIG. 2, or in place storage of the stem when not in use. The cap 20 may be provided with an electrical outlet 84 into which a lighted decorative item, such as the star 82, may be connected to light the tree topper decoration.

In addition to the electrical outlet 84 in the cap 20, a number of additional electrical outlets 86 may be provided, especially at each shelf level, to allow electrical connection of lighted ornamentation or the like which may be displayed on the shelves of the display stand 10. These ornaments may take the form of lighted miniature buildings and the like which are popular Christmas display items.

In order to control the various lights and electrical outlets disposed on the stand 10, various electrical switching controls may be provided as illustrated on the end panel 64 of the base cabinet 60. As illustrated here, separate controls 88 and 90 may be provided to switch the various lights 52–56 and receptacles 84 and 86 "on" or "off" and to control the decorative lights about the perimeter of the display stand, as shown uncovered in FIG. 3. These switches may take the form of conventional multiple position switches used to selectively supply electrical power from the electrical supply cord 93 (see FIG. 3), when plugged into an appropriate power outlet, to the lights and receptacles disposed in the display stand and to the decorative lights forming the artificial Christmas tree profile. The wiring for the various lights and receptacles is disposed within the tubular structural members of the display stand to prevent electrical shock and to hide the various wires running to the lights and receptacles. The preferred manner in which the covered Christmas tree lights are mounted and covered by a removable covering means will be described in detail hereinbelow.

Referring now to FIGS. 2 and 3, wherein like reference numerals refer to identical parts shown in FIG. 1 the manner in which the display stand may be readily converted from a display stand as shown in the front view FIG. 2 to an artificial lighted Christmas tree as shown in FIG. 3 will be described. As shown in FIG. 2, wherein all of the lights are shown covered, the structure takes the appearance of a triangular shaped display stand However, when the lights are uncovered, as shown in FIG. 3, the stand appears as a lighted artificial Christmas tree due to the outline of decorative lights 92 disposed in the covered channels of all the perimeter structural members facing the front and back of the stand 10. Further, there is illustrated the treetop ornament 82 mounted on the stem 80 which may be used to further enhance the appearance of the stand when lighted as an artificial Christmas tree.

Although the tubular structural members forming the outline of the display structure 10 may take various forms, such as rectangular or circular cross-section metal or plastic elements with a decorative polished gold or silver outer surface finish, the preferred form is a rectangular cross-section material with the outward facing side hinged to the adjoining side as illustrated in FIGS. 1, 2 and 3 by like primed numbers to that of the corresponding structural member. As shown, the structural members 14,16 and 18 on the front, as best shown in FIG. 2, include corresponding hinges 14', 16' and 18', while the rear facing members 25, 26 and 28 include hinges 25', 26' and 28' as best shown in FIG. 3. As shown in FIGS. 2 and 3, the front and rear facing structural members 36 and 38 forming the perimeters of the shelves include hinges 36' and 38', respectively. As illustrated in FIG. 4, the hinged cover portion 38" rotates out of the way to reveal the lights 92 mounted in the coverable channels of the structure. Although, the structure illustrated, shows a continuous hinge, such as a piano hinge, it will be understood that various other continuous or spaced hinges may be used to allow the covers to be readily removed to reveal the decorative lights 92.

Figure 5:
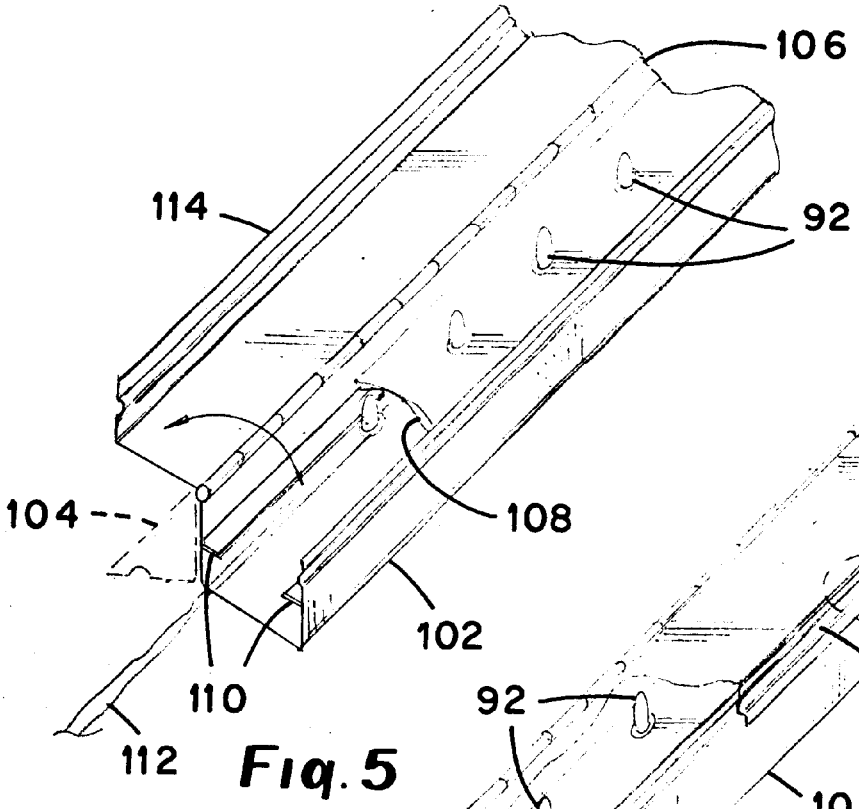
FIG. 5 is an enlarged sectional view of a typical section of the tubular structural members of the triangular display stand assembly, illustrating the mounting of electrical decorative lighting within the tubular member with the removable light cover in place over the lights.
Figure 6:
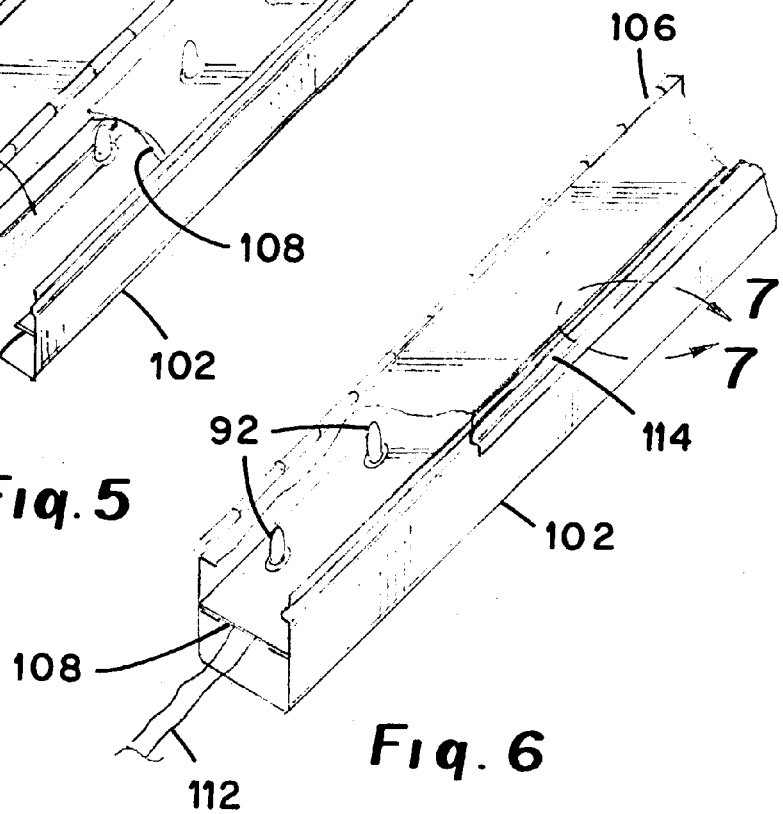
FIG. 6 is an alternate enlarged sectional view of the shown in FIG. 5 with the removable light cover removed, or hinged away as shown in this illustration, to reveal the decorative lights.
Figure 7:
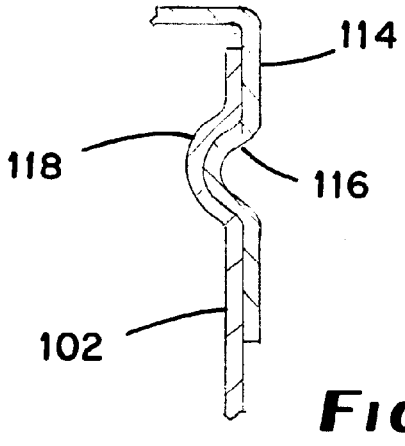
FIG. 7 is a partial cross-sectional view of a section of the tubular enclosure structure taken along lines 7—7 of FIG. 6 illustrating the manner in which the hinged removable covers are held in the closed position over the lights 92.

Referring now to FIGS. 5–7, the manner in which the decorative lights are mounted in the tubular structural members making up the outer perimeter of the display stand will be described. As shown, these rectangular cross-section, tubular members include a back elongated box, or channel shaped, member 102 with an elongated cover member 104 which is hinged to the back member 102 by means of hinge 106. The lights 92, which are preferably formed of continuous strings of decorative Christmas lights, are disposed in the box 102 in an orderly spaced apart manner by a mounting means, such as the elongated mounting plate 108. The plate 108 may be mounted to mounting ledges 110 provided in the walls of box 102. The mounting plate 108 may be removably held in place on the mounting ledges by means of screws (not shown) or other conventional attachment means so that the plates 108 hold the lights 92 in the desired spaced relationship while concealing the electrical wiring 112 connected to the lights 92. The lights 92 may be mounted in the plate so that the light sockets fit firmly into the holes in the mounting plate allowing any burned out bulbs to easily replaced.

When the covers 104 are opened they may be rotated out of position over the lights 92 to the position shown in phantom in FIG. 5. However, when the cover 104 is closed, as shown in FIGS. 6 and 7, the cover is further provided with an integral tab portion which extends over the side of the box 102 opposite the hinge 106 when closed so that the tab extends along and parallel to the side of the box 102 in the closed position. The tab 114 includes an inward extending shallow rib 116 which extends along the entire length thereof and is aligned to engage a corresponding rib 118 extending along the length of the side of the box 102 opposite the corner mounted hinge so that the ribbed portions align and snap into engagement when the hinged cover is closed to hold the cover 104 in the closed position. To open the cover 104, one simply pulls the hinged cover out to disengage the ribs and rotates the cover back out of position from over the lights 92, thereby uncovering the lights for diaplay.

Figure 8:
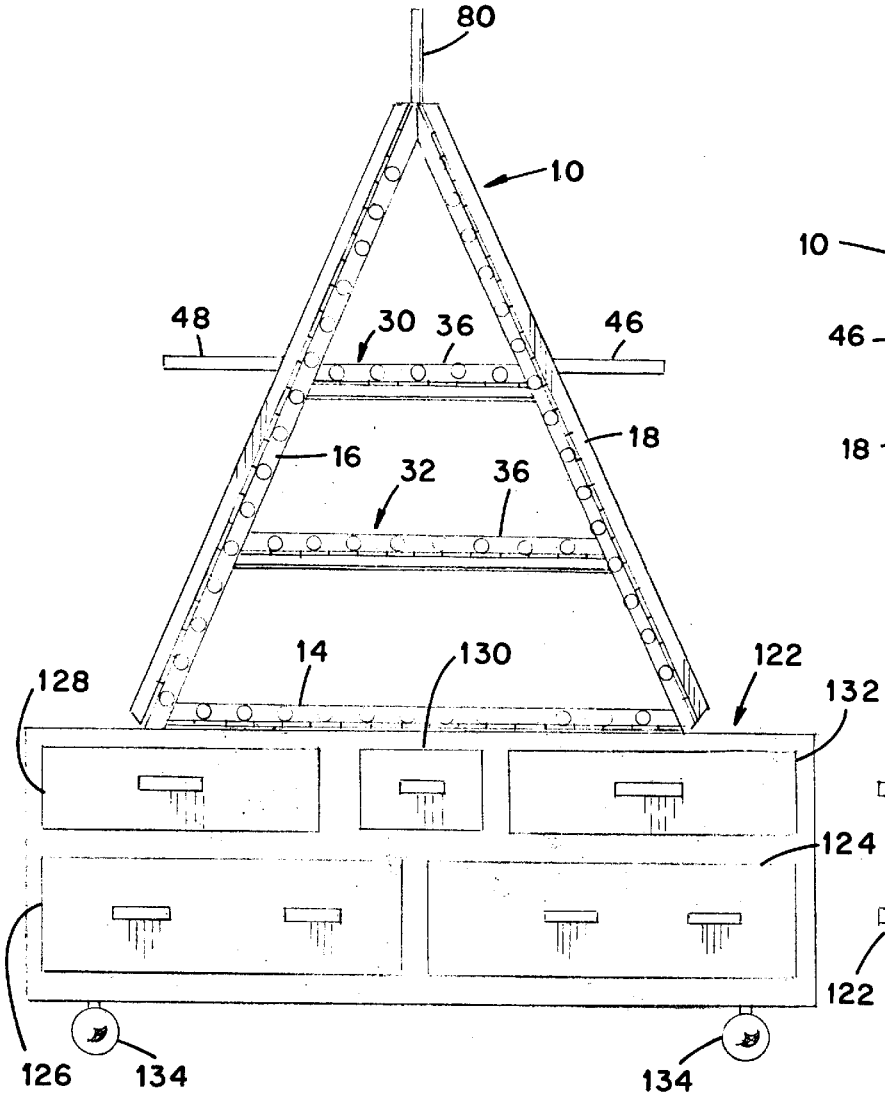
FIG. 8 is a front elevational view of an alternate embodiment of the combination display stand and lighted Christmas tree according to the present invention in which the triangular display structure 10 is disposed atop a storage cabinet.
Figure 9:
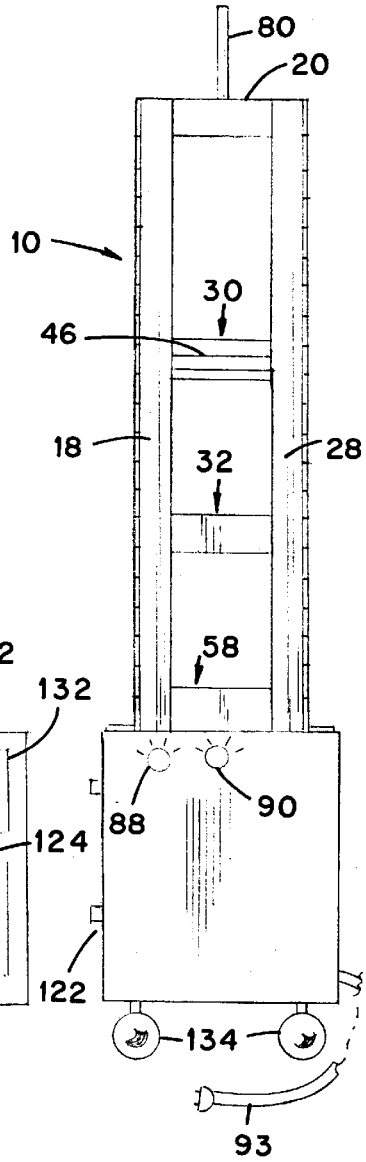
FIG. 9 is an end elevational view of the right side of the embodiment shown in FIG. 8.

Referring now to FIG. 8 and 9, wherein like reference numerals indicate similar parts to that shown in FIG. 1., there is shown an alternate embodiment of the convertible display stand according to the present invention in which the triangular display stand 10 is mounted on top of a cabinet 122. As shown, the base cabinet may be larger than the base of the triangular display stand 10 to accommodate storage of various items in drawers 124–132 mounted in a conventional manner in the cabinet 122. It will be obvious that various drawer arrangements may be built into the cabinet depending on the specific application for the display stand. This embodiment is primarily intended to be used in a situation where the stand would be placed in front of a window or other opening which does not extend all the way to the floor. Thus, the cabinet 122 would have a height sufficient to support the display stand at a level consistent with the height of the window so that when the decorative lights are revealed, as shown in FIG. 8, the outline of the Christmas tree would be visible through the window. The cabinet may be made of known furniture manufacturing materials such as solid wood, veneered wood, plastic, or the like. Preferably, the base is formed of materials and methods consistent with know furniture manufacturing and the display stand 10 is formed of polished metal parts, as described above, to provide an appealing piece of furniture for use in the home, office or commercial application Typically, in this embodiment, the display stand would be shorter in height and only include the two top shelves 30 and 32, as shown, and the base member 14 would be mounted to the top of the base cabinet 122. As shown, the display stand in this embodiment may include the fold out shelves 46 and 48, as well as the treetop ornament mount 80. Further, the display stand 10 may include all of the various shelf lights and electrical outlets (not shown in FIGS. 8 and 9), as illustrated and described with reference to FIG. 1. The lights and electrical outlets on the display stand may be controlled in the same manner as described above by means of similar controls 88 and 90 mounted on the side of the cabinet 122, as shown in FIG. 9, and connecting the power cord 93 to a conventional power outlet. The entire assembly may be supported on wheels 134, mounted to the cabinet base at the comers thereof, so that the complete stand may be moved about as needed.

Thus it will be seen that a display stand has been provided which can be quickly converted to expose decorative lighting about the structural perimeter of the stand to resemble a lighted Christmas tree.

Although, this invention has been described by means of illustration of preferred embodiments disclosing the best modes presently contemplated for the invention, it will be obvious to those skilled in the art that various modifications and changes may be made without departing from the spirit and scope of the invention as set forth in the following claims which depend from and form a part of this specification.

What is claimed is:

1. A combination display stand and artificial Christmas tree, comprising:

a display assembly including front and back spaced apart triangular shaped members, each of said triangular shaped members comprising a base and two upwardly extending side members connected, respectively, between opposite ends of said base member and a common connecting point at an apex above said base so as to form an open triangular shaped structure which resembles the outline of a Christmas tree when viewed from the front or back face of said structure and at least one horizontally disposed shelf supported between said front and back triangular shaped members, said at least one shelf including front and rear facing portions forming a part of said front and rear triangular shaped members, respectively, and wherein said base and each of said side members of said front and back triangular shaped members and said front and back facing portions of said at least one shelf including an outward facing opening along the length thereof so as to form a front facing and a rear facing open channel all about the perimeter of said front and back triangular shaped members;

a plurality of decorative lights disposed in said front and rear facing channels of said front and rear triangular shaped members; and covering means for selectively covering said plurality of lights in said front and rear facing open channels of said front and rear triangular shaped members so that when said decorative lights are uncovered said display stand resembles an artificially lighted Christmas tree and when said decorative lights are covered said stand resembles a conventional display stand.

2. The combination as set forth in claim 1, wherein said front and back open triangular shaped members and said front and back edge portions of said at least one shelf are formed of corresponding lengths of a generally tubular cross-section member having an outward facing open side along the length thereof for forming said outward facing open channels and wherein said cover means includes a hinged cover overlying said outward facing open channels and forming an integral part of each of said lengths of tubular cross-section members.

3. The combination as set forth in claim 2, further including a cabinet disposed between and included within the area between said base members of said front and back triangular shaped members and the first one of said plurality of shelves above said base members, said cabinet including at least one drawer therein.

4. The combination as set forth in claim 2, further including a cabinet disposed below said base members of said front and back triangular shaped members, said cabinet including at least one drawer therein.

5. A combination display stand and artificial Christmas tree, comprising:

a display assembly including front and back open triangular shaped members of identical shape and disposed in a spaced apart relationship to form an open triangular structure having front and back sides, respectively, each of said triangular shaped members having a base and two upwardly extending side members connected, respectively, between the opposite ends of said base member and a connecting point at an apex above said base so as to form an open triangular shape resembling the outline of a Christmas tree, and a plurality of shelves disposed between and connected to said front and back triangular shaped members by means of front and back edge portions, respectively, which form a part of said perimeter of said open triangular structure so that said display stand resembles the outline of a Christmas tree when viewed from the front or back side of said display stand, said front and back open triangular shaped members and said front and back edge portions of said plurality of shelves each being formed of corresponding lengths of generally tubular cross-section members having an outward facing open channel along the lengths thereof;

a plurality of decorative lights disposed about the perimeter of said front and back triangular shaped members of said display assembly within said open face channels of each of said tubular cross-section members; and covering means including a hinged cover overlying said open channel and forming an integral part of each of said lengths of tubular cross-section members for selectively covering said plurality of decorative lights so that when said decorative lights are uncovered said display stand resembles an artificially lighted Christmas tree and when said decorative lights are covered said stand resembles a conventional display stand.

6. The combination as set forth in claim 5, wherein said generally tubular cross-section members are rectangular tubular cross-section members having one side removed to form said open channel therein.

7. The combination as set forth in claim 6, wherein said plurality of decorative lights includes a string of electrical Christmas lights disposed throughout the perimeter of said front and back sides of said display assembly.

8. The combination as set forth in claim 7, further including means for mounting said lights in an orderly array within said open channels of said tubular cross-section members.

9. The combination as set forth in claim 7, further including a cap member connected between the apexes of said front and back triangular shaped members, said cap having an angular cross-section corresponding to the angle at the apexes of said triangular shaped members to form a hood at the top of said display assembly.

10. The combination as set forth in claim 9, wherein said cap member includes an upwardly extending decorative stem for receiving a decorative item to be mounted thereon.

11. The combination as set forth in claim 10, further including a cabinet disposed between and included within the area between said base members of said front and back triangular shaped members and the first one of said plurality of shelves above said base members, said cabinet including at least one drawer therein.

12. The combination as set forth in claim 10, further including a cabinet disposed below said base members of said front and back triangular shaped members.

13. The combination as set forth in claim 12 wherein said cabinet includes at least one drawer.

14. The combination as set forth in claim 5, wherein each of said plurality of shelves includes a removable floor member disposed between and supported by said front and rear edge portions.

15. The combination as set forth in claim 14, wherein said removable floor members are formed of a transparent material.

16. The combination as set forth in claim 15, further including lighting means disposed above each shelf for illuminating the area of the corresponding shelf.

17. The combination as set forth in claim 5, further including at least one pair of shelf extensions pivotally mounted on opposite sides of said display stand between said front and back triangular shaped members so that said shelf extensions may be pivoted from a stored position aligned with the sides of said front and back triangular members and out of view from the front or back of said display stand to a horizontal position.

* * * * *